United States Patent [19]

Janatka et al.

[11] 4,081,296

[45] Mar. 28, 1978

[54] DIRECT-CURRENT ELECTRICAL HEAT-TREATMENT OF CONTINUOUS METAL SHEETS IN A PROTECTIVE ATMOSPHERE

[75] Inventors: Vladimir Janatka, Woodbury; James J. Dolan, Southport, both of Conn.

[73] Assignee: ValJim Corporation, Bridgeport, Conn.

[21] Appl. No.: 592,916

[22] Filed: Jul. 3, 1975

Related U.S. Application Data

[60] Continuation-in-part of Ser. No. 401,031, Sep. 26, 1973, abandoned, which is a division of Ser. No. 342,818, Mar. 19, 1973, Pat. No. 3,792,684.

[51] Int. Cl.[2] ..... C21D 1/74

[52] U.S. Cl. ..... 148/16; 148/16.7; 148/20.3; 148/150; 148/153; 148/154; 148/156; 148/157; 427/319; 427/320; 427/321

[58] Field of Search ..... 148/154, 13.2, 15, 16, 148/16.7, 20, 20.3, 156, 157, 150, 153; 427/319, 320, 321

[56] References Cited

U.S. PATENT DOCUMENTS 2,457,870 1/1949 Cook ..... 148/154

*Primary Examiner*—R. Dean

*Attorney, Agent, or Firm*—Samuel Lebowitz

[57] ABSTRACT

The heat treatment of a continuous band or sheet of metal as the same travels through a plurality of stages in a protective atmosphere, between conveying rollers, by applying direct-current electricity to the rollers for inclusion of the travelling sheet in the circuit therebetween. The charged rollers in the initial stage are spaced more widely from one another than those in the later stage, to compensate for the lower resistivity of the metal in the former, so that the Joule effect of $I^2R$ factor in the stages are substantially equalized. The protective atmosphere of oxidizing, reducing or inert gases which encompasses the sheet, is confined in chambers of galvanized iron sheeting and the like, the walls of which are in close proximity to the travelling sheet, so that lesser amounts of reacting gases are necessary. Furthermore, no inductive electric currents are generated in the walls of the chambers, as is the case when alternating currents are applied to the conveying rollers, with the consequent heat loss. The lack of any extraneous source of heat within the chamber through which the metal sheet passes, other than the direct-current energy, results in a system of low thermal inertia with the capability of a fine and rapid control of the heating to produce uniform physical and metallurgical properties across the entire width of the sheet up to the edges thereof. The heat treatment may be executed for the purpose of annealing or tempering the sheet or modifying its surface coating, either independently or preparatory to the coating thereof in a coating bath.

6 Claims, 6 Drawing Figures

DIRECT-CURRENT ELECTRICAL HEAT-TREATMENT OF CONTINUOUS METAL SHEETS IN A PROTECTIVE ATMOSPHERE

This application is a continuation-in-part of our copending application, Ser. No. 401,031, filed Sept. 26, 1973, abandoned which in turn is a division of our application Ser. No. 342,818, filed Mar. 19, 1973, now U.S. Pat. No. 3,792,684, issued Feb. 19, 1974.

BACKGROUND AND SUMMARY OF THE INVENTION

The invention contemplates the improvement in systems for the heat-treatment of a continuous traveling length of a metal sheet or band which is heated by electrical currents passing therethrough in the course of its travel through a pluraity of stages between conveyor or guide rolls or pulleys to which are applied electrical potentials.

The invention seeks to improve upon such systems as are disclosed in the patents of the prior art, and particularly such as are disclosed in the U.S. Pat. to Cook, No. 2,457,870 and others. While this patent discloses the resistive heating of electrically conductive wire in successive stages of shorter lengths to compensate for the increased resistivity of the wire in its travel from the inlet to the outlet of the system, with the use of alternating current energy, serious problems arise when such an expedient is adapted to the resistive heating of lengths of conductive material of wide area or those having a substantial width to thickness ratio, when such are enclosed within metallic chambers for protective gases used in the heat treatment of the material.

The instant invention seeks to overcome these problems by use of direct-current energy which prevents the induction of any currents in the walls of the sheet iron ductwork defining the chambers which surround the travelling band, thereby increasing the efficiency of the installation as well as minimizing the initial cost and the maintenance costs thereof. The direct current is applied to at least three electrified pulleys, each successive pulley having an opposite polarity.

The use of direct-current makes possible the placement of the sheet iron ductwork close to the travelling band, so that the radiant heat emanating from the latter is confined within a relatively small space and the quantities of gas which react with the travelling sheet and/or the coatings formed thereon may be reduced in quantity, as a consequence. Thus, the chambers for housing the travelling metal, which require no source of extraneous heat, are characterized by minimal thermal inertia and are capable of rapid shut-downs and re-starting operations, without substantial loss of time, energy and gases.

It is the object of the present invention to provide a highly compact and economical installation for the heat treatment of continuous lengths of metal bands or sheets for the purpose of imparting accurately controlled degrees of heat thereto for the purpose of modifying the physical and/or metallurgical properties of the metal, which installation may be complemented by additional apparatus for tempering, annealing or chemically treating the metal for further processing such as quenching, pickling or coating procedures.

It is a further object of the invention to provide an apparatus for the heat treatment of continuous lengths of metal bands or sheets, which occupies a minimum amount of floor area, which may be built up of low cost modular structural units, and which may be maintained in service for maximum periods of time without costly shut-downs when interruptions or break-downs occur.

It is a further object of the invention to provide an installation which is of particular utility in the heat treatment of continuous lengths of ferrous metal in the form of sheets, bands or strips, which are heat treated preparatory to the coating thereof with another metal such as aluminum, zinc, tin or the like, which procedure requires the effective cleaning of the surface of the metal to remove the oxides therefrom. This requires the passage of the continuous length of metal through chambers containing a protective gaseous atmosphere which is non-oxidizing or reducing in chemical behavior, which treats the travelling length of metal in the course of its advance towards a molten metal coating bath. The protective gas is introduced into the chambers for travel in countercurrent relation to the direction of the travelling length of metal, to increase the efficiency of the system as the metal is first heated accurately to the desired temperature, followed by the cooling thereof and the hot dipping of the metal for the application of the coating thereto, in the course of its passage from the inlet to the outlet of the apparatus.

The invention contemplates the economical heat treatment of continuous lengths of ferrous metal preparatory to the passage thereof through coating baths of molten metal which are treated for the purpose of clearing the metal of objectionable oxide layers, with or without the annealing of the metal. Alternatively, the heat treatment of the continuous lengths of ferrous metal may be executed preparatory to the passage of the critically heated metal through quenching baths, if tempering characteristics are sought to be imparted to the metal, or other liquid baths such as pickling solutions and the like.

DESCRIPTION OF THE PREFERRED EMBODIMENT

Figure 1:
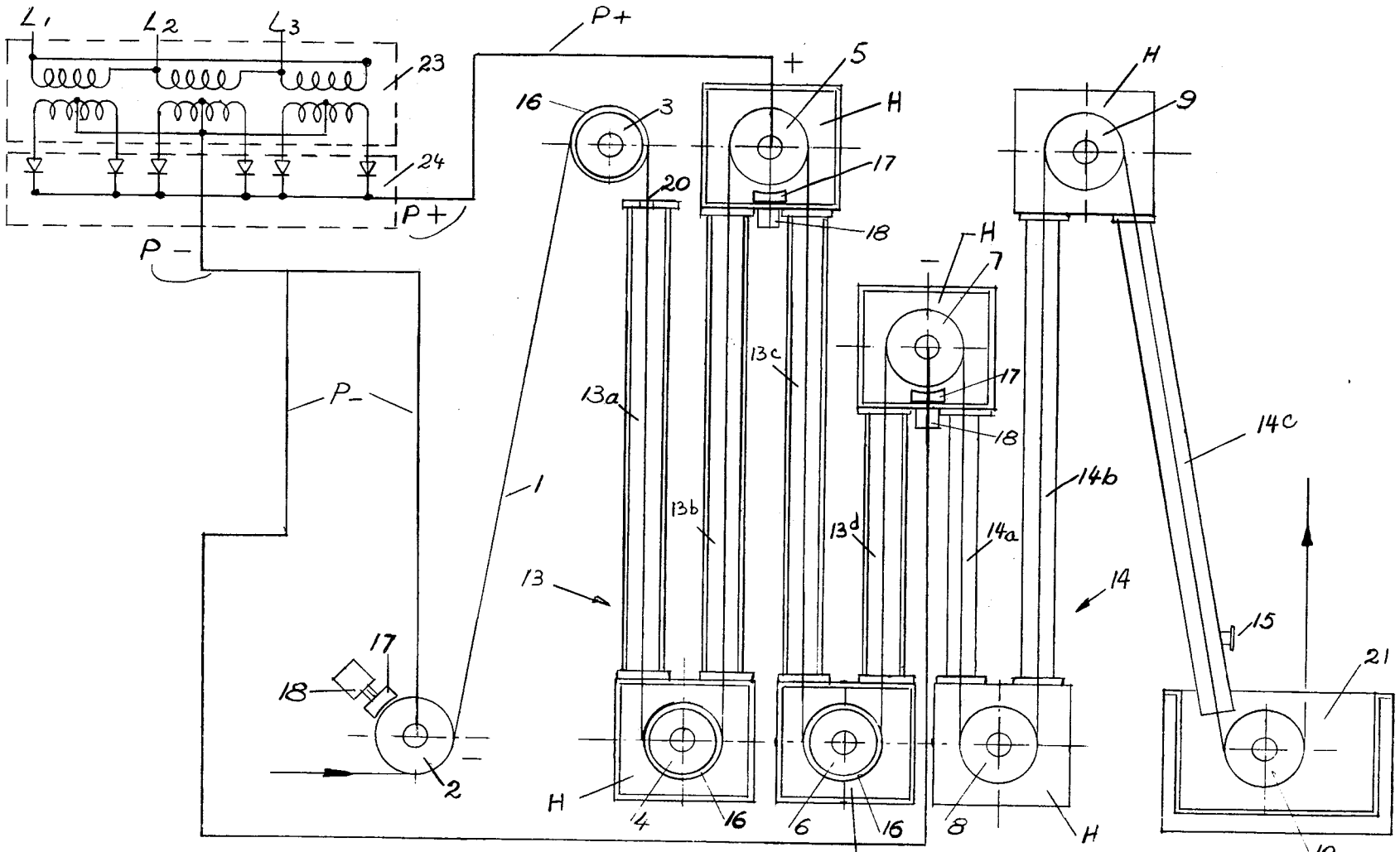
FIG. 1 is a schematic cross-sectional view of the apparatus in accordance with the invention, including a block diagram of the power supply, indicating the line of travel of a continuous sheet of metal as it passes through the heat treating stages, cooling stages, and ultimately a coating bath.

In the schematic diagram of the system shown in FIG. 1, a three-phase transformer 23 is shown connected to a three-phase power line L1, L2 and L3 which reduces the line voltage of the latter about 100 volts in the secondary windings, and the output of which is fed to a thyristor rectifier bank which rectifies the current supplied by the transformer. Any other type of rectifier which produces relatively ripple-free direct-current can be used for this purpose, and the rectifier elements may be other than thyristors, for example, silicon controlled rectifiers, Zener diodes, selenium cells, etc. Such power conversion systems are well known in the art.

Figure 4:
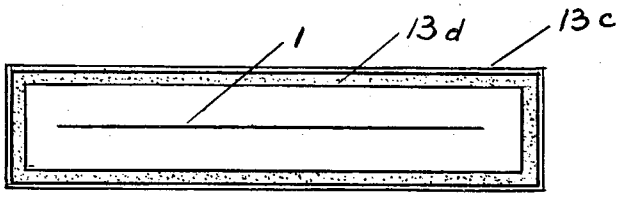
FIG. 4 is a horizontal sectional view along line A—A of FIG. 3.

The direct-current output leading from the rectifier is connected to three electrically charged guide or conveyor rollers of the system. As shown in FIG. 1, the negative main P− is connected to rollers 2 and 7 and the positive main P+ is connected to roller 5. The guide rollers 5 and 7 are enclosed in sealed housings H, to which are connected the chambers or ducts 13*a*, 13*b*, 13*c* and 13*d* of relatively small cross-section, with the walls thereof in close proximity to the travelling sheet 1, as shown in FIG. 4.

Additional guide pulleys 3, 4 and 6 are provided in alternating arrangement with the pulleys 2, 5 and 7 to reverse the direction of the sheet of metal 1 as it is guided in zig-zag paths around electrified pulley 2 and over pulley 3 into the series of ducts of the reducing chamber. In addition, pulleys 8 and 9, with housings H and ducts 14*a*, 14*b* and 14*c*, are provided to guide the heated sheet of metal through these cooling chambers and into the tank 21 whereat is provided another guide pulley 10 over which the coated metal passes upwardly for final disposition, as is well known in the art. While the ducts are disposed vertically in the illustrated embodiment, they may be horizontal or inclined, in dependence upon the available space therefor and the plant layout. The vertical arrangement of the cooling and reducing chambers requires a minimum amount of floor space.

Rollers 3, 4 and 6 are coated with a layer 16 of insulating material, preferably of a ceramic composition, in order to avoid sparking between the metal sheet and the surface of said pulleys because the sheet would otherwise be short-circuited in the course of its contact with half of the periphery of these pulleys between the guide rollers which are charged with potentials of opposite polarity.

Metal sheet 1 is guided under negatively charged pulley 2 past insulated guide pulleys 3 and 4 and becomes heated when it makes contact with electrically heated pulley 5. The sheet becomes progressively heated as it advances towards the outlet end of the system and reaches its maximum temperature as it approaches charged roller 7. The portion of the sheet which remains in a normal atmosphere before its entry into the reducing chambers at slot 20, permits the residual oil to burn off before the sheet enters the first insulated duct or chamber 13*a*. The latter is filled with a reducing gas which is fed into the ductwork through inlet 15 adjacent to the outlet end of chamber 14*c*, and which is heated by heat abstracted from the sheet 1 passing through the cooling ducts as well as the heated sheet. Under certain conditions, the sheet is allowed to oxidize slightly before it enters the first chamber 13*a*, because the reduced oxide layer serves as an excellent base for the subsequent coating operation.

After the first stage of heating in the passage of the sheet through chambers 13*a* and 13*b*, the sheet enters the second stage after it passes over positively charged pulley 5 and past guide pulley 6 to the negatively charged pulley 7. As stated above, the sheet attains its maximum temperature shortly before contacting pulley 7 and after passing through the housing H enclosing this pulley, the sheet enters the chamber 14*a* which is the first cooling section of the reducing chamber, wherefrom it passes under pulley 8 and over pulley 9 towards the molten coating bath in pot 21 without being exposed to the atmosphere.

Figure 3:
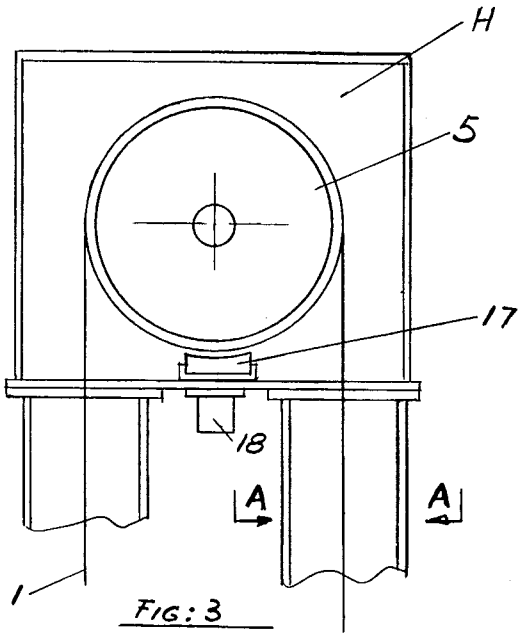
FIG. 3 is an enlarged sectional view of the positively charged pulley with the abrasive cleaning bar cooperating therewith.

In order to maintain good electrical contact between the travelling sheet of metal and the conductive rollers 2, 5 and 7, which become coated with impurities such as carbonized oil, ferric or ferrous oxide, etc., abrasive bars 17 are provided adjacent these rollers, with an arcuate cleaning surface conforming to the lateral surface of the latter, with means for pressing these bars against the faces of the electrified rollers. In FIG. 3 is shown an enlarged view of pneumatic or hydraulic cylinder which may be operated periodically to clear the lateral surfaces of the electrified rollers from these impurities.

Figure 5:
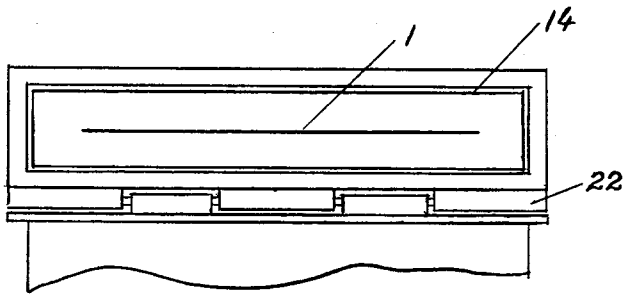
FIG. 5 is a sectional view along line B—B of FIG. 2.

The introduction of the reducing gases through inlet 15 in counter-current relation to the travel of the sheet towards the exit orifice 20, results in a safe installation and one which is economical in operation. The close spacing between the walls of the reducing and cooling chambers 13 and 14, with respect to the travelling sheet 1, as clearly shown in FIGS. 4 and 5, gives rise to a relatively high velocity of the reducing gases. The high velocity of the gas permits the use of a gas containing less than 10% hydrogen, in contradistinction to conventional reducing furnaces which operate with a hydrogen concentration of 25% to 75%. The low concentration of hydrogen offers several advantages such as the elimination of the need for the use of an ammonia dissociator which may be replaced with an exothermic gas generator which is simpler and cheaper in operation. Also, the use of a gas containing less than 10% hydrogen eliminates the danger of explosion in case some oxygen accidentally enters into the chamber, because hydrogen is not flammable when diluted to a concentration as low as 10%. This also eliminates the need for prolonged purging during start-up and stoppages.

The relatively close spacing between the travelling sheet of metal and the walls of the chambers is desirable for the purpose of utilizing the reducing gases at maximum efficiency, for only the portions of the latter in contact with the sheet react with the surfaces of the metal, as described above. However, such close spacing gives rise to inductive currents in the walls of the ductwork when such are of conventional sheet metal and when wide sheets are electro-resistively heated with alternating currents, resulting in energy losses. The saving in energy by the use of direct current in accordance with the invention is substantial, as illustrated by the following example.

When a travelling band or strip 30 inches wide and 0.030 inch thick is subjected to an alternating current potential of 333 amperes per meter it will reach a temperature of 800° C. at the exit from the reduction chamber. When direct current is used for the same purpose, a current of 256 amperes is sufficient to obtain the same temperature at the exit from said chamber, while the speed of the strip in both cases remains unchanged. This represents a saving of 23%, which with the use of alternating current would be lost because of the aforementioned inductive effect.

There is still another difficulty created by the use of alternating current. Upon experimentation it has been found that when a strip of metal is heated by the "short circuit" or resistive method using alternating current power, the heat distribution across the strip width is unequal. The edges of the strip become overheated while the center of the strip remains at lower temperature. The severity of this temperature difference is proportional to the width of the strip—the wider the strip, the greater the temperature difference between the center and its edges. This "edge effect" is also proportional to the frequency of the alternating current; the higher the frequency, the more pronounced is the "edge effect."

Therefore, the use of direct-current energy results in both energy savings and an improved sheet having uniform characteristics over its entire area.

Figure 6:
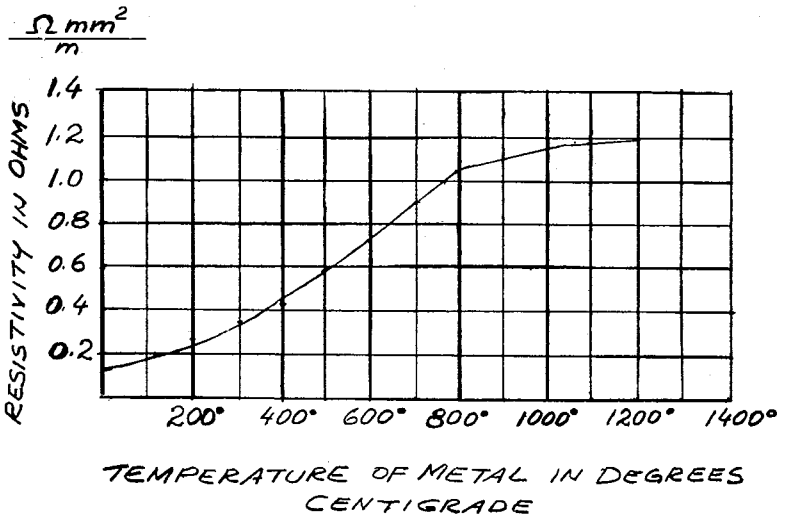
FIG. 6 is a graph showing the relationship between the temperature and the electrical resistivity of a low carbon steel strip.

As is evident from FIG. 1, the first heating stage between electrified rollers 2 and 5 is much longer than the second heating stage between electrified rollers 5 and 7, in fact about twice as long. This results in a more efficient utilization of the power supply, which may be explained by reference to FIG. 6.

It is a well known fact that the resistivity of a conductor is affected by its temperature. This relationship is shown in the graph in FIG. 6 where the resistivity of low-carbon steel is plotted against its temperature. This phenomenon makes possible an increase in efficiency of the process executed by the system shown in FIG. 1. Thus, the travelling band or strip reaches the first electrified pulley 2 at room temperature and progressively increases its temperature so that it reaches the second positively electrified pulley 5 at a temperature of about 500° C. It continues its travel and reaches the last electrified pulley 7 at a temperature of about 1000° C. From the graph in FIG. 6 it can be seen that at room temperature the resistivity of the strip is about 0.18 Ohms/mm$^2$/m, and at 500° C. the resistivity is 0.58 Ohms/mm$^2$/m, which averages 0.38 Ohms/mm$^2$/m. In the second stage, the initial resistivity is 0.58 Ohms/mm$^2$/m, and at the end thereof it is 1.17 Ohms/mm$^2$/m at 1000° C. Consequently, the average resistivity of the strip in the second stage is 0.88 Ohms/mm$^2$/m. Therefore, if both stages were to have the same resistivity, then their length relationship should be 0.80 : 0.38 or the first stage should be 2.1 times the length of the second one. By following the methods described above, it is possible to produce a galvanized strip 40 inches wide and 0.030 inch thick with a power consumption of less than 200 KW/ton, which is a significant saving in energy when compared to a conventional process.

Figure 2:
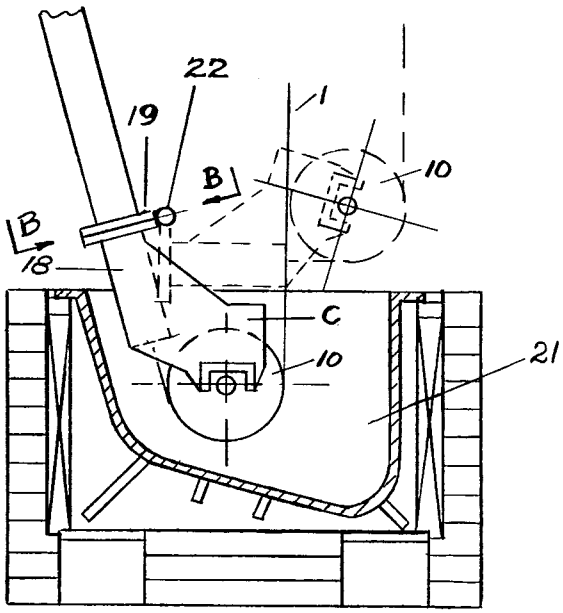
FIG. 2 is a sectional view of another embodiment of the coating bath at the outlet end of the apparatus, having a hinged guide pulley which may be lifted therefrom during shut-down periods.

As shown in FIG. 4, the reducing chambers 13 may be lined with an insulating layer 13*d*, whereas the cooling chambers 14 are devoid of such a lining to enhance the cooling operation. This expedient contributes to the attainment of the desirable characteristic of the invention, namely, its low thermal inertia. It is therefore economically feasible to operate the reduction chambers intermittently. However, during a galvanizing process it is necessary to maintain the metal contained in the zinc bath 21 in a molten state, during brief shutdown periods. But it is not advisable to maintain the relatively thin strip submerged in the molten zinc because the zinc will dissolve it, and re-threading of the chamber becomes necessary. Consequently, the final pulley 10 is rotatably mounted at the lower end of discharge conduit C, which in turn is hingedly mounted by means of hinge 22 to the lower end 19 of cooling duct 14*c* (FIGS. 2 and 5). This construction permits the lifting of the guide pulley to an inoperative position during shut-down periods, as indicated in dotted lines in FIG. 2. In operation, the flanged lower end 19 is clamped to a mating flange on the discharge conduit C by means of a plurality of "C" clamps.

The reducing gas fed into inlet 15 is preferably admitted at a slight over-pressure above atmospheric, of about 1 inch water column.

We claim:

1. The method of electrically heat-treating a continuous travelling band of sheet metal of substantial width relative to its thickness as it passes through a protective atmosphere in a confining chamber for the latter and the band, with minimum energy loss, which comprises (a) conducting the band continuously in zig-zag paths, at a predetermined speed, from a source of supply at the inlet and over a plurality of spaced guide rollers towards the outlet, (b) applying direct-current potentials to at least some of said rollers of electrically conductive metal, and thereby to successive passes of the band, to generate resistive heating therein to the exclusion of any other extraneous heating within said chamber, (c) reducing the length of the successive passes from the inlet to the outlet end of the travelling band to compensate for the increase in the electrical resistivity of the band with the increase in temperature thereof in the course of its travel, thereby to equalize the Joule effect in the successive passes, (d) restricting the quantum of the ambient atmosphere adjacent to said travelling band by confining the travel of said band through metallic housings of elongate and reduced cross-section corresponding to the large width and small thickness of the travelling band, by disposing the walls of said housings in close proximity to the opposite faces and edges of the travelling band, thereby maximizing the temperature of the said housings and atmosphere therein, solely by the radiant heat emanating from the travelling band of metal, without any heating effects resulting from inductive currents in the housing walls and consequent waste of electrical energy, and (e) conditioning the ambient atmosphere in contact with the travelling band by introducing a gaseous agent into said housings adjacent to the outlet for exhaust adjacent to the inlet, thereby effecting gas flow in counter-current relation relative to the travel of the band of sheet metal therethrough.

2. The method set forth in claim 1, wherein the gaseous agent which is introduced into said housings adjacent to the outlet is a reducing gas which is preheated by the outgoing band, and which in turn is simultaneously cooled by the gas preparatory to passage through a metal coating bath.

3. The method set forth in claim 2, wherein the reducing gas has a hydrogen content no greater than 10%.

4. The method set forth in claim 2, wherein the band undergoing heat-treatment is ferrous sheeting preparatory to galvanizing, which includes leading the treated sheet into a molten zinc coating bath without exposure to the atmosphere, following the resistive heating passes and the attainment of the maximum treating temperature at the conclusion thereof, and the subsequent cooling thereof by the incoming reducing gas.

5. The method set forth in claim 4, wherein the maximum treating temperature at the conclusion of the resistive heating passes is approximately 1000° C.

6. The method set forth in claim 4, wherein the reducing gas is composed of approximately 10% hydrogen and 90% nitrogen.

* * * * *